US011628670B2

(12) United States Patent
Kyojima

(10) Patent No.: US 11,628,670 B2
(45) Date of Patent: Apr. 18, 2023

(54) LIQUID DISCHARGE HEAD, LIQUID DISCHARGE DEVICE, AND LIQUID DISCHARGE APPARATUS

(71) Applicant: Ryosuke Kyojima, Hokkaido (JP)

(72) Inventor: Ryosuke Kyojima, Hokkaido (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/472,736

(22) Filed: Sep. 13, 2021

(65) Prior Publication Data

US 2022/0080729 A1 Mar. 17, 2022

(30) Foreign Application Priority Data

Sep. 17, 2020 (JP) ..... JP2020-156114

(51) Int. Cl.
*B41J 2/14* (2006.01)

(52) U.S. Cl.
CPC ..... *B41J 2/1433* (2013.01)

(58) Field of Classification Search
CPC ..... B41J 2/1433
See application file for complete search history.

(56) References Cited

U.S. PATENT DOCUMENTS

| | | | | |
|---|---|---|---|---|
| 2008/0211871 | A1 | 9/2008 | Sakurai et al. | |
| 2009/0301998 | A1 | 12/2009 | Uchiyama et al. | |
| 2010/0116423 | A1 * | 5/2010 | Reitmeier | B41J 2/1623 156/230 |
| 2019/0126622 | A1 | 5/2019 | Kuramoto et al. | |
| 2019/0283414 | A1 * | 9/2019 | Yoshida | B41J 2/04566 |

FOREIGN PATENT DOCUMENTS

| | | | |
|---|---|---|---|
| CN | 101284447 | A | 10/2008 |
| CN | 209111754 | U | 7/2019 |
| JP | 2006-347155 | | 12/2006 |
| JP | 2010-142991 | | 7/2010 |
| JP | 2012-106364 | | 6/2012 |
| KR | 20000026006 | A * | 5/2000 |
| KR | 10-0464307 | B1 | 2/2005 |

OTHER PUBLICATIONS

Extended European Search Report dated Feb. 28, 2022 in European Patent Application No. 21197164.3, 10 pages.
Chinese Office Action dated Dec. 26, 2022 in corresponding Chinese Patent Application No. 20211105977.4, 6 pages.

* cited by examiner

*Primary Examiner* — Jason S Uhlenhake
(74) *Attorney, Agent, or Firm* — Xsensus LLP

(57) ABSTRACT

A liquid discharge head includes a nozzle plate, an individual liquid chamber, and an actuator. The nozzle plate has a nozzle on a liquid discharge face and a through hole communicating with the nozzle and penetrating the nozzle plate. The nozzle plate includes a substrate including a first silicon layer on a side of the liquid discharge face, a second silicon layer, a first silicon oxide film layer, and a second silicon oxide layer on a surface of the second silicon layer different from a surface of the second silicon layer in contact with the first silicon oxide film layer. A thickness of the first silicon layer is smaller than a thickness of the second silicon layer. A portion of the through hole penetrating the first silicon layer has a smaller diameter than a portion of the through hole penetrating the second silicon layer.

7 Claims, 12 Drawing Sheets

FIG. 1
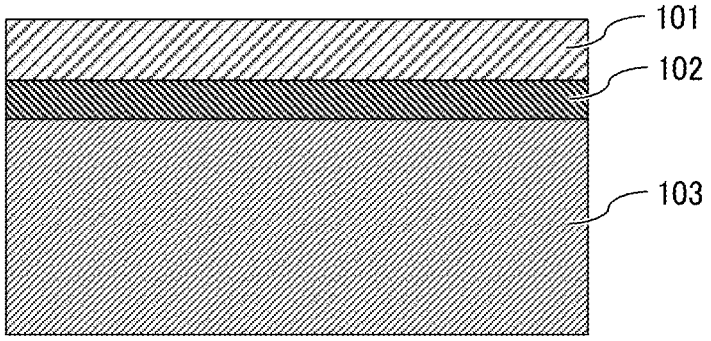
FIG. 2 COMPARATIVE EXAMPLE
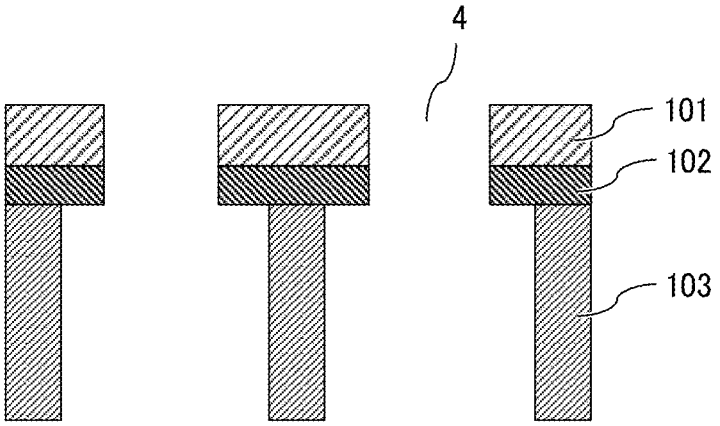

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-156114, filed on Sep. 17, 2020, in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus.

Description of the Related Art

Inkjet recording apparatuses have many advantages, such as extremely noiseless operation, high-speed printing, a high degree of flexibility in ink, i.e., liquid for image formation, and availability of low-cost plain paper. Accordingly, the inkjet recording apparatuses are widely used as image recording apparatuses or image forming apparatuses, such as printers, facsimile machines, and copiers.

The basic function of an inkjet head used in the inkjet recording apparatus is to discharge ink droplets perpendicularly to the surface of a sheet. If the inkjet head discharges ink droplets obliquely, a streak may appear in an image formed on the sheet, thereby impairing the quality of the image. To avoid such a situation, the key configuration of the inkjet head includes the shape of a nozzle from which ink is discharged.

The nozzle is formed on a nozzle plate. There is known a technique for manufacturing a two stage nozzle plate using silicon (Si) etching and silicon dioxide ($SiO_2$) etching on a silicon on insulator (SOI) substrate. The SOI substrate has a structure in which a silicon oxide film layer is sandwiched between one silicon layer and the other silicon layer, and is generally used for manufacturing a large scale integration (LSI). When such a two stage nozzle plate is manufactured, for example, an SOI wafer is ground and thinned, and the front and back surface of the SOI wafer are patterned and etched. This manufacturing process uses the property of a silicon oxide film layer having a high etching selectivity with respect to silicon.

SUMMARY

Embodiments of the present disclosure describe an improved liquid discharge head that includes a nozzle plate, an individual liquid chamber, and an actuator. The nozzle plate has a nozzle on a liquid discharge face and a through hole communicating with the nozzle and penetrating the nozzle plate. The nozzle plate includes a substrate including a first silicon layer on a side of the liquid discharge face, a second silicon layer, a first silicon oxide film layer between the first silicon layer and the second silicon layer, and a second silicon oxide film layer on a surface of the second silicon layer different from a surface of the second silicon layer in contact with the first silicon oxide film layer. The individual liquid chamber communicates with the nozzle via the through hole. The actuator pressurizes a liquid in the individual liquid chamber to discharge the liquid from the nozzle. A thickness of the first silicon layer is smaller than a thickness of the second silicon layer. A portion of the through hole penetrating the first silicon layer has a smaller diameter than a portion of the through hole penetrating the second silicon layer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 1 is a schematic cross-sectional view illustrating a configuration of a silicon on insulator) SOI substrate;

FIG. 2 is a schematic cross-sectional view of a nozzle plate of a liquid discharge head according to a comparative example;

Figure 3:
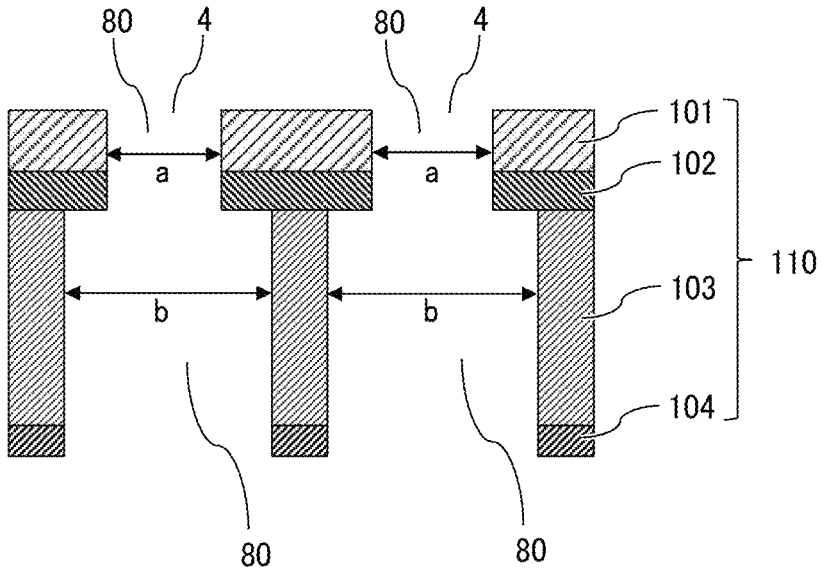
FIG. 3 is a schematic cross-sectional view of a nozzle plate of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity.

However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a," "an," and "the" are intended to include the plural forms as well, unless the context clearly indicates otherwise.

Hereinafter, a liquid discharge head, a liquid discharge device, and a liquid discharge apparatus according to embodiments of the present disclosure is described with reference to the drawings. It is to be noted that the following embodiments are not limiting the present disclosure and any deletion, addition, modification, change, etc. can be made within a scope in which person skilled in the art can conceive including other embodiments, and any of which is included within the scope of the present disclosure as long as the effect and feature of the present disclosure are demonstrated.

According to embodiments of the present disclosure, a liquid discharge head includes a nozzle plate, an individual liquid chamber, and an actuator. The nozzle plate has a nozzle on a liquid discharge face and a through hole communicating with the nozzle and penetrating the nozzle plate. The nozzle plate includes a substrate including a first silicon oxide film layer, a first silicon layer on a side of the liquid discharge face, and a second silicon layer. The second silicon layer includes a second silicon oxide film layer on a surface of the second silicon layer different from a surface of the second silicon layer in contact with the first silicon oxide film layer. The first silicon layer and the second silicon layer sandwich the first silicon oxide film layer. The individual liquid chamber communicates with the nozzle via the through hole. The actuator pressurizes a liquid in the individual liquid chamber to discharge the liquid from the nozzle. A thickness of the first silicon layer is smaller than a thickness of the second silicon layer. A portion of the through hole penetrating the first silicon layer has a smaller diameter than a portion of the through hole penetrating the second silicon layer.

A nozzle plate according to the present embodiment includes a silicon on insulator (SOI) substrate. FIG. 1 is a schematic cross-sectional view illustrating a configuration of the SOI substrate. The SOI substrate includes a first silicon layer 101, a second silicon layer 103, and a first silicon oxide film layer 102 sandwiched between the first silicon layer 101 and the second silicon layer 103. The SOI substrate has a structure in which a silicon oxide film layer having a high etching selectivity with respect to silicon is sandwiched between one silicon layer and the other silicon layer.

A surface of a silicon substrate is oxidized, and another silicon substrate is attached to one surface of the silicon substrate to manufacture an SOI wafer. Accordingly, the variation in the thickness of the SOI wafer falls within a range of several hundreds nm. In view of such a point, the SOI substrate is used in a two stage nozzle plate because the height of a small-diameter cylindrical portion serving as a nozzle hole of an inkjet head can be controlled with high accuracy. When the two stage nozzle plate including the SOI substrate is manufactured, for example, the SOI wafer is ground and thinned, and the front and back surface of the SOI wafer are patterned and etched. This manufacturing process uses the property of a silicon oxide film layer having a high etching selectivity with respect to silicon.

FIG. 2 is a schematic cross-sectional view of a comparative two stage nozzle plate including the SOI substrate. The two stage nozzle plate according to the comparative example has a nozzle 4 and includes the SOI substrate including the first silicon layer 101, the second silicon layer 103, and the first silicon oxide film layer 102 sandwiched between the first silicon layer 101 and the second silicon layer 103.

In a comparative technique, when the wafer is thinned in the above-described manufacturing process, the wafer is significantly warped toward the first silicon layer 101 due to the residual stress of the first silicon oxide film layer 102. When the wafer is warped, the amount of warpage of the wafer varies in the plane thereof. Therefore, the visual inspection of the wafer may require a large number of focus points, thereby increasing the inspection time.

FIG. 3 is a schematic cross-sectional view of the two stage nozzle plate including the SOI substrate according to the present embodiment. The two stage nozzle plate illustrated in FIG. 3 is different from the two stage nozzle plate in FIG. 2 in that a second silicon oxide film layer 104 is formed. In the present embodiment, a nozzle plate 110 includes the second silicon oxide film layer 104 on a surface of the second silicon layer 103 different from a surface of the second silicon layer 103 in contact with the first silicon oxide film layer 102. The surface different from the surface in contact with the first silicon oxide film layer 102 includes a surface opposite to the surface in contact with the first silicon oxide film layer 102. In the present embodiment, the nozzle plate 110 includes the second silicon oxide film layer on the surface of the second silicon layer 103 opposite to the surface of the second silicon layer 103 in contact with the first silicon oxide film layer 102.

Since the second silicon oxide film layer 104 is formed, the residual stress of the second silicon oxide film layer 104 can cancel the residual stress generated from the first silicon oxide film layer 102, thereby reducing the warpage of the wafer. As the warpage of the wafer is reduced, the amount of warpage of the wafer is prevented from varying in the plane thereof. Therefore, the focus points in the visual inspection does not increase, and thus the inspection time does not increase.

Next, details of the present embodiment are described with reference to FIG. 3. The nozzle plate 110 according to the present embodiment has the nozzle 4 and includes the SOI substrate including the first silicon layer 101, the second silicon layer 103, and the first silicon oxide film layer 102 between the first silicon layer 101 and the second silicon layer 103. The nozzle plate 110 further includes the second silicon oxide film layer 104. In the nozzle plate 110, the first silicon layer 101 is disposed on a side of a liquid discharge face of the liquid discharge head. In FIG. 3, the upper side of the drawing corresponds to the liquid discharge face from which liquid is discharged.

To prevent the liquid from being obliquely discharged, the thickness of the first silicon layer 101 is preferably about 15 μm or less. To secure rigidity of the wafer, the total thickness of the first silicon layer 101 and the second silicon layer 103 is preferably 50 μm or more. As a result, the thickness of the first silicon layer 101 is smaller than the thickness of the second silicon layer 103.

The SOI substrate in the nozzle plate 110 has a through hole 80 communicating with the nozzle 4. In the present embodiment, as illustrated in FIG. 3, a diameter a of a portion of the through hole 80 penetrating the first silicon layer 101 is smaller than a diameter b of a portion of the through hole 80 penetrating the second silicon layer 103

(i.e., a<b). When this relation of a<b is satisfied, the nozzle plate 110 including the SOI substrate is referred to as the two stage nozzle plate.

In the nozzle plate 110, as a diameter of an outlet of the nozzle 4 is small, minute ink droplets can be discharged from the nozzle 4. As a result, the resolution of images is improved, and high-quality images can be formed. On the other hand, as a volume of the nozzle 4 or the through hole 80 communicating with the nozzle 4 is small, the fluid resistance increases, and the flexibility in discharge control is impaired. Therefore, preferably, the diameter of the outlet of the nozzle 4 is small, and the nozzle 4 has the two stage shape to reduce the fluid resistance. In addition, preferably, the through hole 80 extends in a direction perpendicular to the substrate as illustrated in the present embodiment. In this case, liquid droplets can be discharged from the nozzle 4 with high accuracy.

In the two stage nozzle plate, preferably, a depth of the small-diameter portion of the through hole 80, in other words, the total thickness of the first silicon layer 101 and the first silicon oxide film layer 102 is determined in consideration of discharge characteristics. Specifically, the total thickness of the first silicon layer 101 and the first silicon oxide film layer 102 is preferably smaller than the thickness of the second silicon layer 103. If the depth of the small-diameter portion of the through hole 80 is too large, the fluid resistance may increase and the discharge characteristics may be impaired. Therefore, by satisfying the above-described relation, the fluid resistance can be prevented from increasing, thereby improving the discharge characteristics.

In addition, when ink is discharged, a liquid level of the ink is required to remain in a nozzle outlet cylinder (i.e., the small-diameter portion of the through hole 80). If the liquid level reaches a large-diameter portion of the through hole 80, the discharge characteristics may be impaired. Therefore, the total thickness of the first silicon layer 101 and the first silicon oxide film layer 102 is preferably 50 μm or more. In this case, the liquid level of the ink is likely to remain at the position corresponding to the first silicon layer 101 or the first silicon oxide film layer 102, thereby preventing the discharge characteristics from being impaired.

In the present embodiment, the center of rigidity in the direction perpendicular to the substrate is within the second silicon layer 103. The second silicon oxide film layer 104 is closer to the center of rigidity than the first silicon oxide film layer 102. Therefore, the thickness of the first silicon oxide film layer 102 is preferably larger than the thickness of the second silicon oxide film layer 104 to balance the stresses of the first silicon oxide film layer and the second silicon oxide film layer 104.

The method of manufacturing the nozzle plate in the present embodiment can be appropriately selected and changed. Examples of the method of manufacturing the nozzle plate include a press method in which a metal plate is pressed to form a hole and a dry etching method in which a hole is etched on the silicon substrate. A dry etching method is preferable from the viewpoint of high controllability of the shape.

For example, the silicon layer of the SOI substrate illustrated in FIG. 1 is dry-etched. When the silicon of the SOI substrate is etched up to the silicon oxide film layer, the silicon etching in the depth direction stops. Since the thickness of the SOI substrate can be controlled in the unit of several hundreds nm, the depth of the outlet small-diameter portion can be easily controlled.

In the comparative two stage nozzle plate, there is widely known an example of manufacturing process in which, after the outlet small-diameter portion is formed, the opposite surface is ground to form a thin film. Then, the large-diameter portion is formed from the ground surface, and finally the silicon oxide film layer is removed.

On the other hand, in the present embodiment, the second silicon oxide film layer and an oxide film layer on the nozzle outlet side are formed by a thermal oxidation processed on the SOI substrate, for example. After that, the oxide film layer on the nozzle outlet side is removed by etching. Next, the nozzle 4 are formed by dry etching on the liquid discharge face of the SOI substrate. Then, a polishing process is performed to adjust the thickness of the wafer to, for example, 50 μm, and finally the through hole 80 is formed by dry etching. Thus, the two stage nozzle plate including the SOI substrate according to the present embodiment is manufactured. Accordingly, the residual stress of the second silicon oxide film layer 104 can cancel the residual stress generated from the first silicon oxide film layer 102, thereby reducing the warpage of the wafer.

Figure 4:
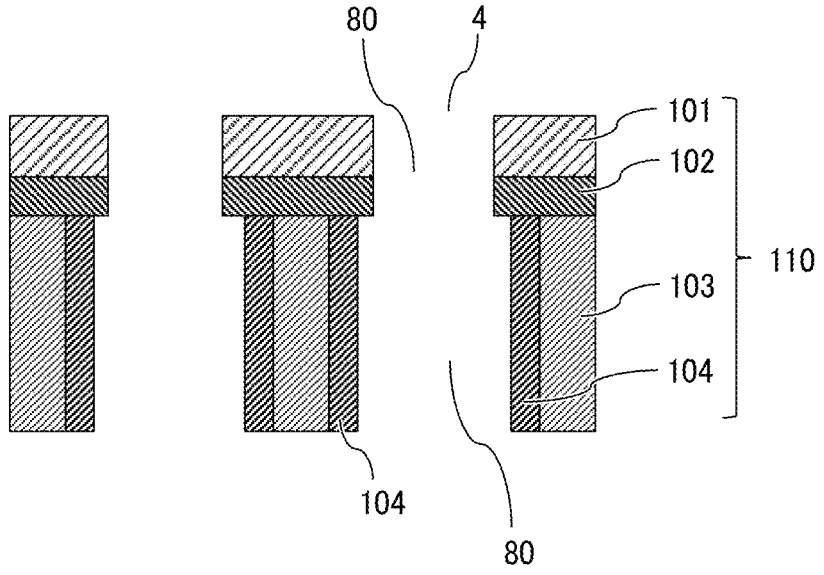
FIG. 4 is a schematic cross-sectional view of a nozzle plate of a liquid discharge head according to another embodiment of the present disclosure.

Next, another embodiment is described. FIG. 4 is a schematic cross-sectional view illustrating a nozzle plate 110 according to another embodiment. FIG. 4 is the cross-sectional view similar to FIG. 3. In the present embodiment, the nozzle plate 110 includes the second silicon oxide film layer 104 on a surface of the second silicon layer 103 different from the surface of the second silicon layer 103 in contact with the first silicon oxide film layer 102. That is, a place where the second silicon oxide film layer 104 is formed is not limited to the place illustrated in FIG. 3, and can be appropriately changed as long as the residual stress generated from the first silicon oxide film layer 102 can be canceled. As illustrated in the present embodiment, the second silicon oxide film layer 104 may be formed on a surface of the second silicon layer 103 facing the through hole 80.

As described above, the place where the second silicon oxide film layer 104 is formed can be appropriately changed. As illustrated in FIG. 4, even if the second silicon oxide film layer 104 is formed only on the surface of the second silicon layer 103 facing the through hole 80, the residual stress generated from the first silicon oxide film layer 102 can be canceled, thereby obtaining the effect of the present disclosure. On the other hand, from the viewpoint of canceling the residual stress generated from the first silicon oxide film layer 102, it is more preferable that the second silicon oxide film layer 104 is formed on the surface of the second silicon layer 103 opposite to the surface in contact with the first silicon oxide film layer 102 and on the surface of the second silicon layer 103 facing the through hole 80. In this case, the residual stress generated from the first silicon oxide film layer 102 can be more surely canceled. In consideration of the manufacturing process, it is more preferable that the second silicon oxide film layer 104 is formed only on the surface of the second silicon layer opposite to the surface in contact with the first silicon oxide film layer 102 as illustrated in FIG. 3.

Figure 5:
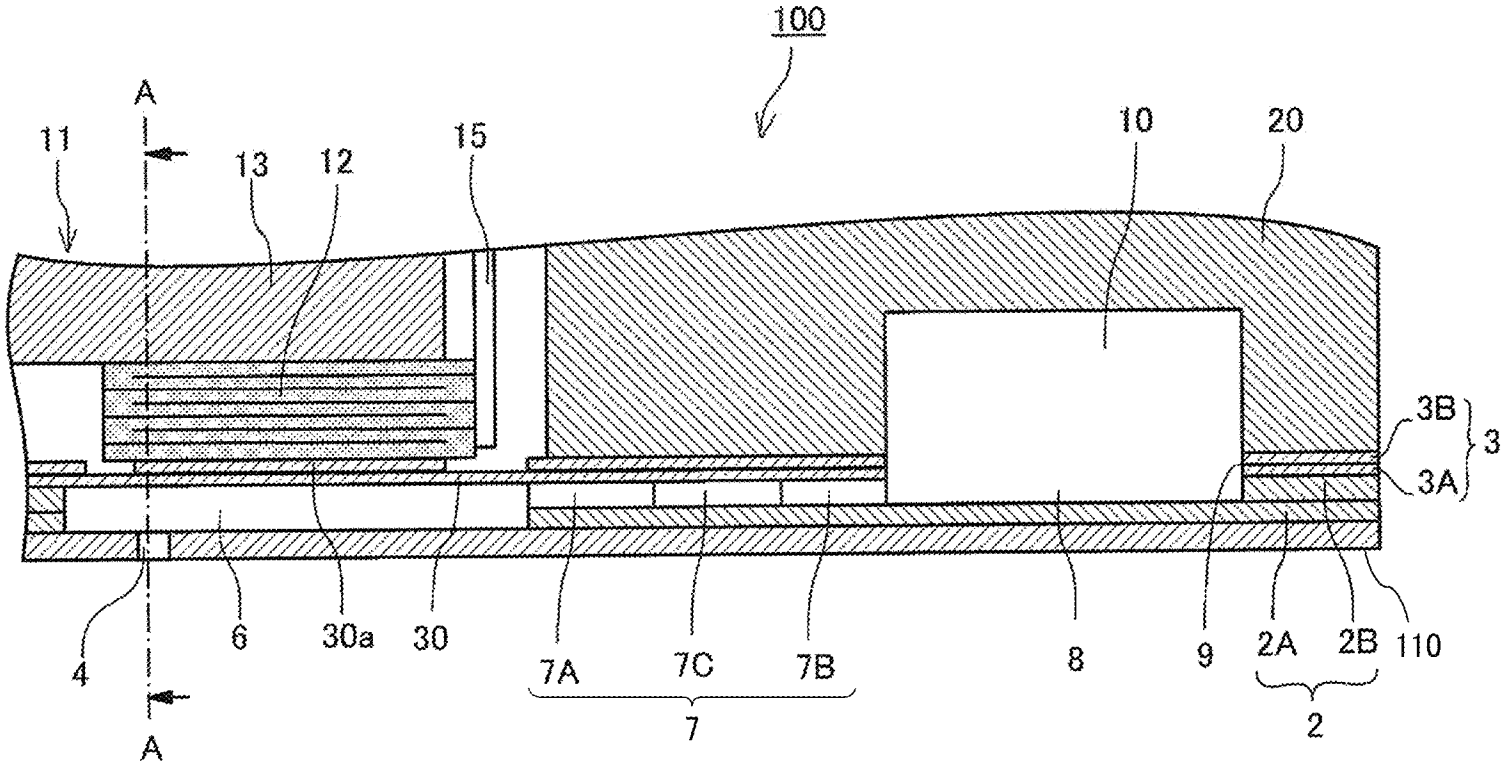
FIG. 5 is a schematic cross-sectional view illustrating an example of the liquid discharge head according to embodiments of the present disclosure.
Figure 6:
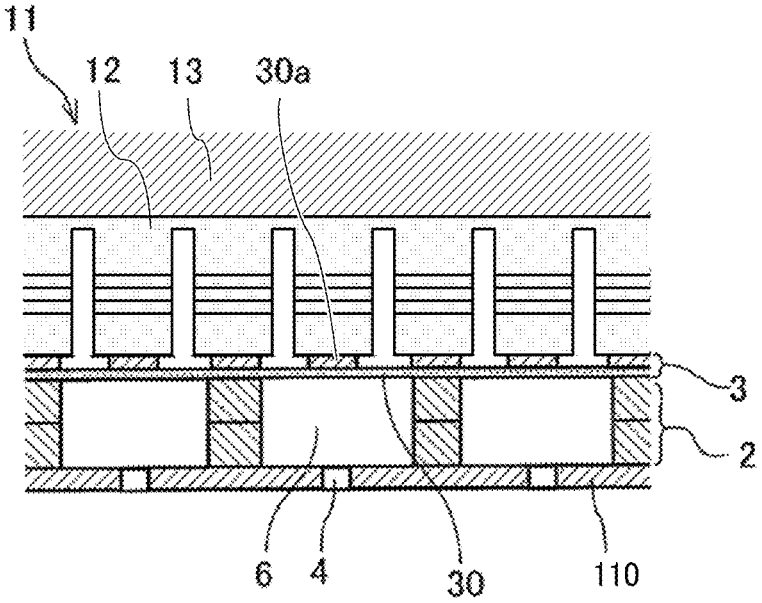
FIG. 6 is another schematic cross-sectional view illustrating the example of the liquid discharge head in FIG. 5 according to embodiments of the present disclosure.

A basic configuration according to the embodiments of the present disclosure is described below, with reference to the accompanying drawings. FIG. 5 is a cross-sectional view illustrating an example of a liquid discharge head 100 in a direction (pressure-chamber longitudinal direction) perpendicular to a nozzle arrangement direction of the liquid discharge head 100 according to the embodiments. FIG. 6 is a cross-sectional view of the liquid discharge head 100 in the nozzle arrangement direction along line A-A in FIG. 5.

The liquid discharge head 100 according to the present embodiment includes the nozzle plate 110, a channel plate 2 as an individual channel member, and a diaphragm 3 as a wall member that are laminated one on another and bonded to each other. The liquid discharge head 100 further includes a piezoelectric actuator 11 as an actuator to displace a vibration portion (vibration plate) 30 of the diaphragm 3 and a common channel member 20 also serving as a frame of the liquid discharge head 100. Note that an individual liquid chamber is also referred to as a pressure chamber 6.

The nozzle plate 110 includes a plurality of nozzles 4 to discharge liquid. In FIGS. and 6 (and FIG. 8), although the nozzle 4 is simply depicted, the nozzle plate 110 has the two stage shape as illustrated in FIGS. 3 and 4.

The channel plate 2 defines a plurality of pressure chambers 6 communicating with the plurality of nozzles 4 via the through holes 80, a plurality of individual supply channels 7 that are individual channels communicating with the respective pressure chambers 6, and a plurality of intermediate supply channels 8 that are liquid introduction portions each communicating with one or the plurality of individual supply channels 7 (e.g., one individual supply channel in the present embodiment).

The diaphragm 3 includes a plurality of displaceable vibration portions (vibration plates) 30 that defines walls of the pressure chambers 6 of the channel plate 2. The diaphragm 3 has a two-layer structure (not limited), and is constructed of a first layer 3A forming a thin portion and a second layer 3B forming a thick portion from the channel plate 2 side. The displaceable vibration portion 30 is formed in a portion corresponding to the pressure chamber 6 in the first layer 3A that is the thin portion. In the vibration portion 30, a projection 30*a* is formed as the thick portion joined to the piezoelectric actuator 11 in the second layer 3B.

The piezoelectric actuator 11 including an electromechanical transducer element serving as a driving device (an actuator device or a pressure generator device) to deform the vibration portion 30 of the diaphragm 3 is disposed on a side of the diaphragm 3 opposite a side facing the pressure chamber 6.

In the piezoelectric actuator 11, a piezoelectric member bonded on a base 13 is grooved by half-cut dicing, to form a desired number of columnar piezoelectric elements 12 at predetermined intervals in a comb shape in the nozzle arrangement direction as illustrated in FIG. 6. The piezoelectric element 12 is bonded to the projection 30*a* that is the thick portion in the vibration portion 30 of the diaphragm 3. The piezoelectric element 12 includes piezoelectric layers and internal electrodes alternately laminated on each other. Each internal electrode is led out to an end face and connected to an external electrode (end face electrode). The external electrode is connected to a flexible wiring 15.

The common channel member 20 defines a common supply channel 10 communicating with the plurality of pressure chambers 6. The common supply channel 10 communicates with the intermediate supply channel 8 as the liquid introduction portion via an opening 9 provided in the diaphragm 3 and communicates with the individual supply channel via the intermediate supply channel 8.

In the liquid discharge head 100, for example, the voltage to be applied to the piezoelectric element 12 is lowered from a reference potential (intermediate potential) so that the piezoelectric element 12 contracts to pull the vibration portion 30 of the diaphragm 3 to increase the volume of the pressure chamber 6. As a result, liquid flows into the pressure chamber 6.

Then, the voltage to be applied to the piezoelectric element 12 is increased to expand the piezoelectric element 12 in the direction of lamination, and the vibration portion 30 of the diaphragm 3 is deformed in a direction toward the nozzle 4 to reduce the volume of the pressure chamber 6. As a result, the liquid in the pressure chamber 6 is pressurized and discharged from the nozzle 4.

Figure 7:
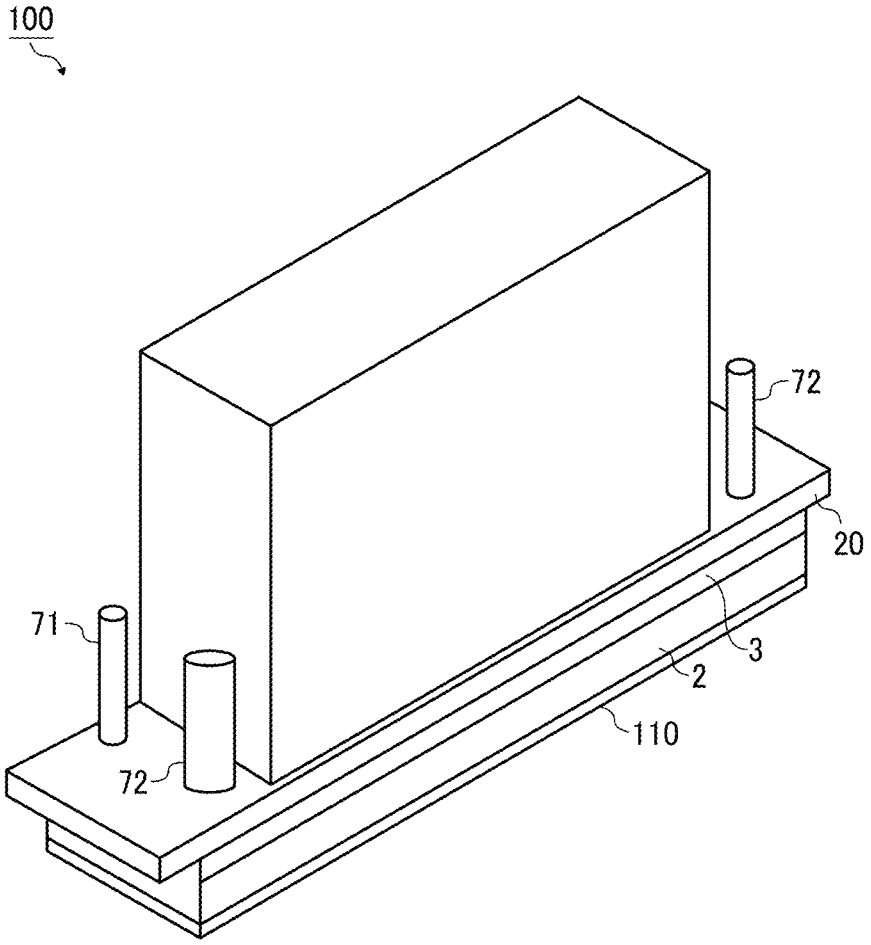
FIG. 7 is a schematic perspective view illustrating another example of the liquid discharge head according to embodiments of the present disclosure.
Figure 8:
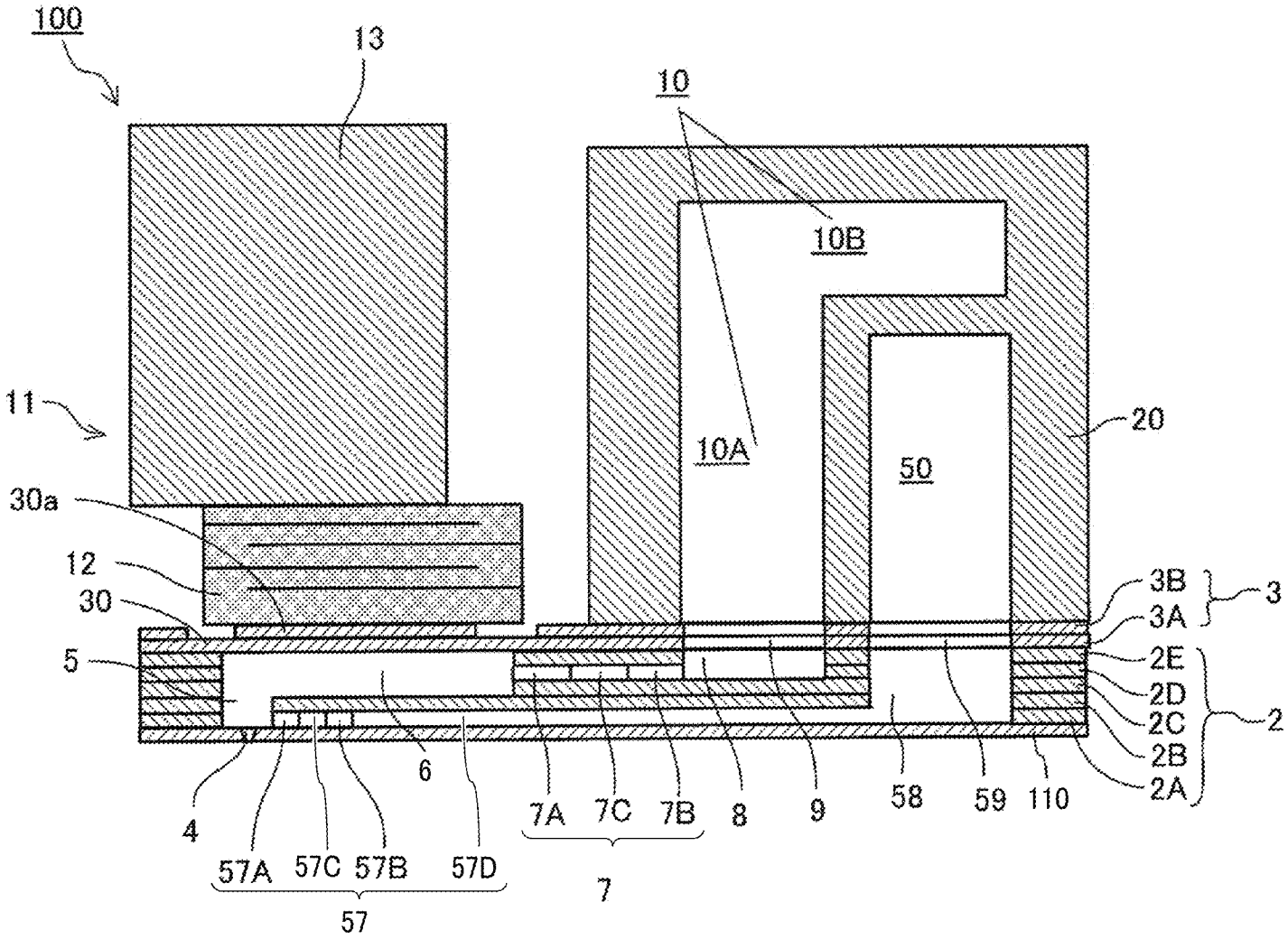
FIG. 8 is a schematic cross-sectional view illustrating the example of the liquid discharge head in FIG. 7 according to embodiments of the present disclosure.

FIG. 7 is a perspective view illustrating another example of the liquid discharge head according to the embodiments of the present disclosure. FIG. 8 is a cross-sectional view illustrating the example of the liquid discharge head 100 in FIG. 7 according to the embodiments of the present disclosure in a direction (pressure-chamber longitudinal direction) perpendicular to the nozzle arrangement direction of the liquid discharge head 100. The liquid discharge head 100 according to the present embodiment is a circulation type liquid discharge head, and includes the nozzle plate 110, the channel plate 2, and the diaphragm 3 as a wall member, which are laminated one on another and bonded to each other. The liquid discharge head 100 further includes the piezoelectric actuator 11 to displace the vibration portion (vibration plate) 30 of the diaphragm 3 and the common channel member 20 that also serves as the frame of the liquid discharge head 100.

The channel plate 2 defines the plurality of pressure chambers 6 communicating with the plurality of nozzles 4 via nozzle communication passages 5, the individual supply channels 7 also serving as a plurality of fluid restrictors communicating with the plurality of pressure chambers 6, and the intermediate supply channels 8 serving as one or a plurality of liquid introduction portions communicating with two or more individual supply channels 7.

Similarly to the above-described example, the individual supply channel 7 includes two channel portions, i.e., a first channel portion 7A and a second channel portion 7B having a higher fluid resistance than the pressure chamber 6, and a third channel portion 7C disposed between the first channel portion 7A and the second channel portion 7B and having a lower fluid resistance than each of the first channel portion 7A and the second channel portion 7B.

The channel plate 2 has a configuration in which a plurality of plate members 2A to 2E are laminated one on another. However, the configuration of the channel plate is not limited thereto.

The channel plate 2 further defines a plurality of individual collection channels 57 and a plurality of intermediate collection channels 58. The individual collection channels 57 are formed along the surface direction of the channel plate 2 that respectively communicate with the plurality of pressure chambers 6 via the nozzle communication passages 5. The intermediate collection channels 58 serves as one or a plurality of liquid lead-out portions that communicates with two or more individual collection channels 57.

The individual collection channel 57 includes two channel portions, i.e., a first channel portion 57A and a second channel portion 57B having a higher fluid resistance than the pressure chamber 6, and a third channel portion 57C disposed between the first channel portion 57A and the second channel portion 57B and having a lower fluid resistance than each of the first channel portion 57A and the second channel portion 57B. The individual collection channel 57 further includes a channel portion 57D downstream from the second channel portion 57B in the direction of circulation of the liquid. The channel portion 57D has the same channel width as the third channel portion 57C.

The common channel member 20 defines the common supply channel 10 and a common collection channel 50. In the present embodiment, the common supply channel 10 includes a channel portion 10A that is disposed side by side with the common collection channel 50 in the nozzle arrangement direction and a channel portion 10B that is not disposed side by side with the common collection channel 50.

The common supply channel 10 communicates with the intermediate supply channel as the liquid introduction portion via the opening 9 provided in the diaphragm 3 and communicates with the individual supply channel 7 via the intermediate supply channel 8. The common collection channel 50 communicates with the intermediate collection channel 58 as the liquid lead-out portion via an opening 59 provided in the diaphragm 3 and communicates with the individual collection channel 57 via the intermediate collection channel 58.

The common supply channel 10 communicates with a supply port 71. The common collection channel 50 communicates with a collection port 72. The other configurations such as layer configuration of the diaphragm 3 and the configuration of the piezoelectric actuator are the same as the configurations in the above-described example.

Also in this liquid discharge head 100, similarly to the above-described example, the piezoelectric element 12 is expanded in the direction of lamination, and the vibration portion of the diaphragm 3 is deformed in the direction toward the nozzle 4 to reduce the volume of the pressure chamber 6. As a result, liquid in the pressure chamber 6 is pressurized and discharged from the nozzle 4.

The liquid not discharged from the nozzle 4 passes the nozzle 4, is collected from the individual collection channel 57 to the common collection channel 50, and is supplied again to the common supply channel 10 through an external circulation passage from the common collection channel 50. In addition, even when the liquid is not discharged from the nozzle 4, the liquid circulates from the common supply channel 10 to the common collection channel through the pressure chamber 6 and is supplied again to the common supply channel 10 through the external circulation passage.

Accordingly, also in the present example, the pressure fluctuation accompanying liquid discharge can be attenuated with a simple configuration, thus restraining propagation of the pressure fluctuation to the common supply channel 10 and the common collection channel 50.

Figure 9:
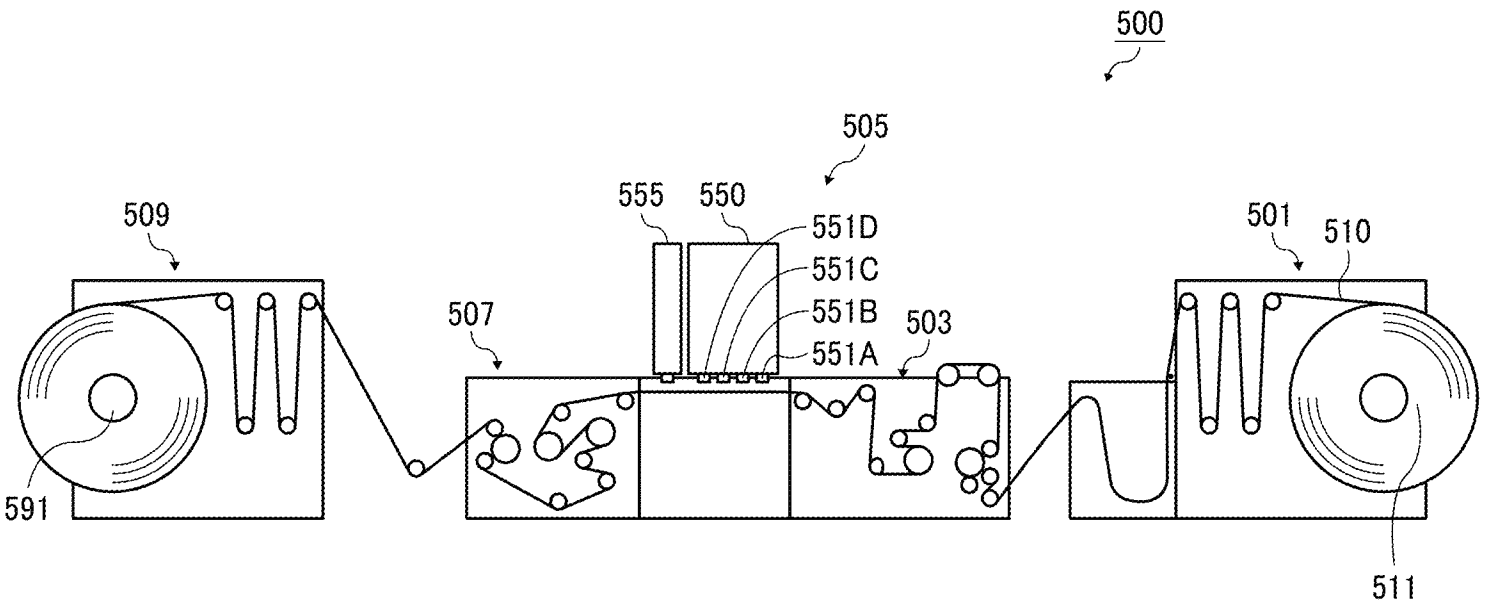
FIG. 9 is a schematic view illustrating an example of a liquid discharge apparatus according to embodiments of the present disclosure.
Figure 10:
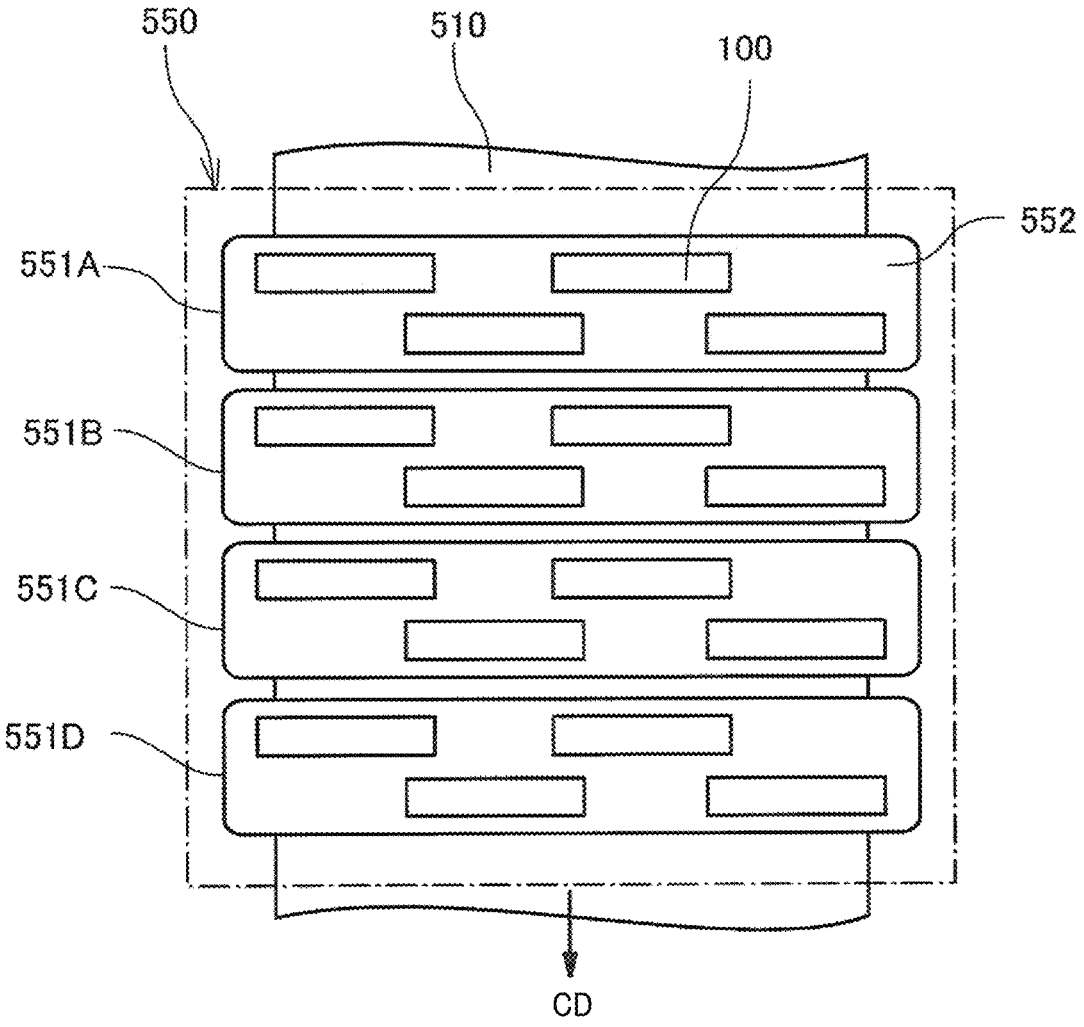
FIG. 10 is a schematic plan view illustrating an example of a head unit of the liquid discharge apparatus in FIG. 9.

Next, an example of a liquid discharge apparatus according to the embodiments of the present disclosure is described with reference to FIGS. 9 and 10. FIG. 9 is a schematic view of the liquid discharge apparatus. FIG. 10 is a plan view of a head unit of the liquid discharge apparatus in FIG. 9.

A printing apparatus 500 serving as the liquid discharge apparatus according to the present embodiment includes, e.g., a feeder 501, a guide conveyor 503, a printer 505, a drier 507, and a carrier 509. The feeder 501 feeds a continuous medium 510 inward. The guide conveyor 503 guides and conveys the continuous medium 510 such as a continuous sheet of paper or a sheet medium fed inward from the feeder 501. The printer 505 performs printing by discharging liquid onto the continuous medium 510 to form an image. The drier 507 dries the continuous medium 510 with the image formed. The carrier 509 feeds the dried continuous medium 510 outward. The continuous medium 510 is fed from a winding roller of the feeder 501, guided and conveyed with rollers of the feeder 501, the guide conveyor 503, the drier 507, and the carrier 509, and wound around a take-up roller 591 of the carrier 509.

In the printer 505, the continuous medium 510 is conveyed on a conveyance guide so as to face a head unit 550 and a head unit 555. An image is formed with liquid discharged from the head unit 550, and post-treatment is performed with treatment liquid discharged from the head unit 555. Here, the head unit 550 includes, for example, full-line head arrays 551A, 551B, 551C, and 551D for four colors from the upstream side in a conveyance direction of the continuous medium 510 indicated by arrow CD in FIG. 10. Hereinafter, the full-line head arrays 551A, 551B, 551C, and 551D are simply referred to as the "head array 551" when colors are not distinguished.

Each of the head arrays 551 is a liquid discharger to discharge liquid of black (K), cyan (C), magenta (M), or yellow (Y) onto the continuous medium 510 conveyed along the conveyance direction of the continuous medium 510. Note that the number and types of colors are not limited to the above-described four colors of K, C, M, and Y and may be any other suitable number and types. In each head array 551, for example, as illustrated in FIG. 10, liquid discharge heads 100 according to the present embodiment are disposed in a staggered arrangement on a base 552 to form the head array 551. Note that the configuration of the head array 551 is not limited to such a configuration. Hereinafter, the liquid discharge head 100 is also simply referred to as the "head 100."

Figure 11:
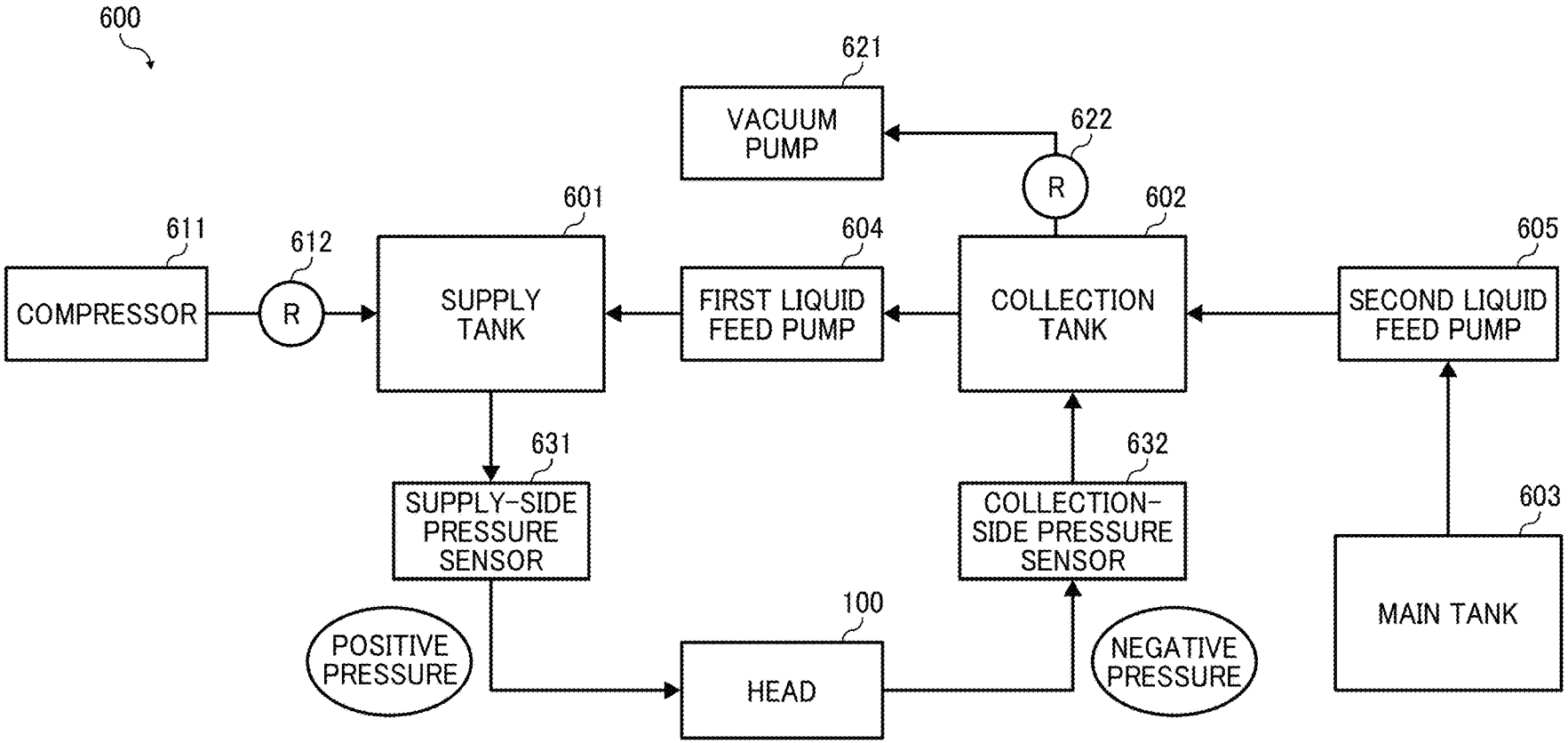
FIG. 11 is a block diagram of a liquid circulation device according to embodiments of the present disclosure.

FIG. 11 illustrates an example of a liquid circulation device 600 employed in the printing apparatus 500 according to the present embodiment. FIG. 11 is a block diagram of the liquid circulation device 600. Although only one head 100 is illustrated in FIG. 11, in the structure including a plurality of heads 100 as illustrated in FIG. 10, a plurality of supply-side flow paths and a plurality of collection-side flow paths are respectively connected via manifolds or the like to the supply sides and collection sides of the plurality of heads 100.

The liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, a supply-side pressure sensor 631, a collection-side pressure sensor 632, and the like.

The compressor 611 and the vacuum pump 621 together generate a difference between the pressure in the supply tank 601 and the pressure in the collection tank 602. The supply-side pressure sensor 631 is disposed between the supply tank 601 and the head 100 and coupled to the supply-side flow path connected to the supply port 71 (see FIG. 7) of the head 100. The collection-side pressure sensor 632 is disposed between the head 100 and the collection tank 602 and coupled to the collection-side flow path connected to the collection port 72 (see FIG. 7) of the head 100.

One end of the collection tank 602 is coupled to the supply tank 601 via the first liquid feed pump 604, and another end of the collection tank 602 is coupled to the main tank via the second liquid feed pump 605. Accordingly, liquid flows from the supply tank into the head 100 through the supply port 71. Then, the liquid is collected from the collection port 72 to the collection tank 602 and is sent from the collection tank 602 to the supply tank 601 by the first liquid feed pump 604, thereby forming a circulation path through which the liquid circulates.

Here, the compressor 611 is coupled to the supply tank 601 and is controlled so that a predetermined positive pressure is detected by the supply-side pressure sensor 631. On the other hand, the vacuum pump 621 is coupled to the collection tank 602 and is controlled so that a predetermined negative pressure is detected by the collection-side pressure sensor 632. Such a configuration allows the meniscus of liquid to be maintained at a constant negative pressure while circulating the liquid through the head 100.

When liquid is discharged from the nozzles 4 of the head 100, the amount of liquid in each of the supply tank 601 and the collection tank 602 decreases. Therefore, the second liquid feed pump 605 appropriately replenishes liquid from the main tank 603 to the collection tank 602. The timing of liquid replenishment from the main tank 603 to the collection tank 602 can be controlled based on, for example, the detection result of a liquid level sensor provided in the collection tank 602. In such a case, for example, the liquid replenishment may be performed when the liquid level of the liquid in the collection tank 602 falls below a predetermined height.

Figure 12:
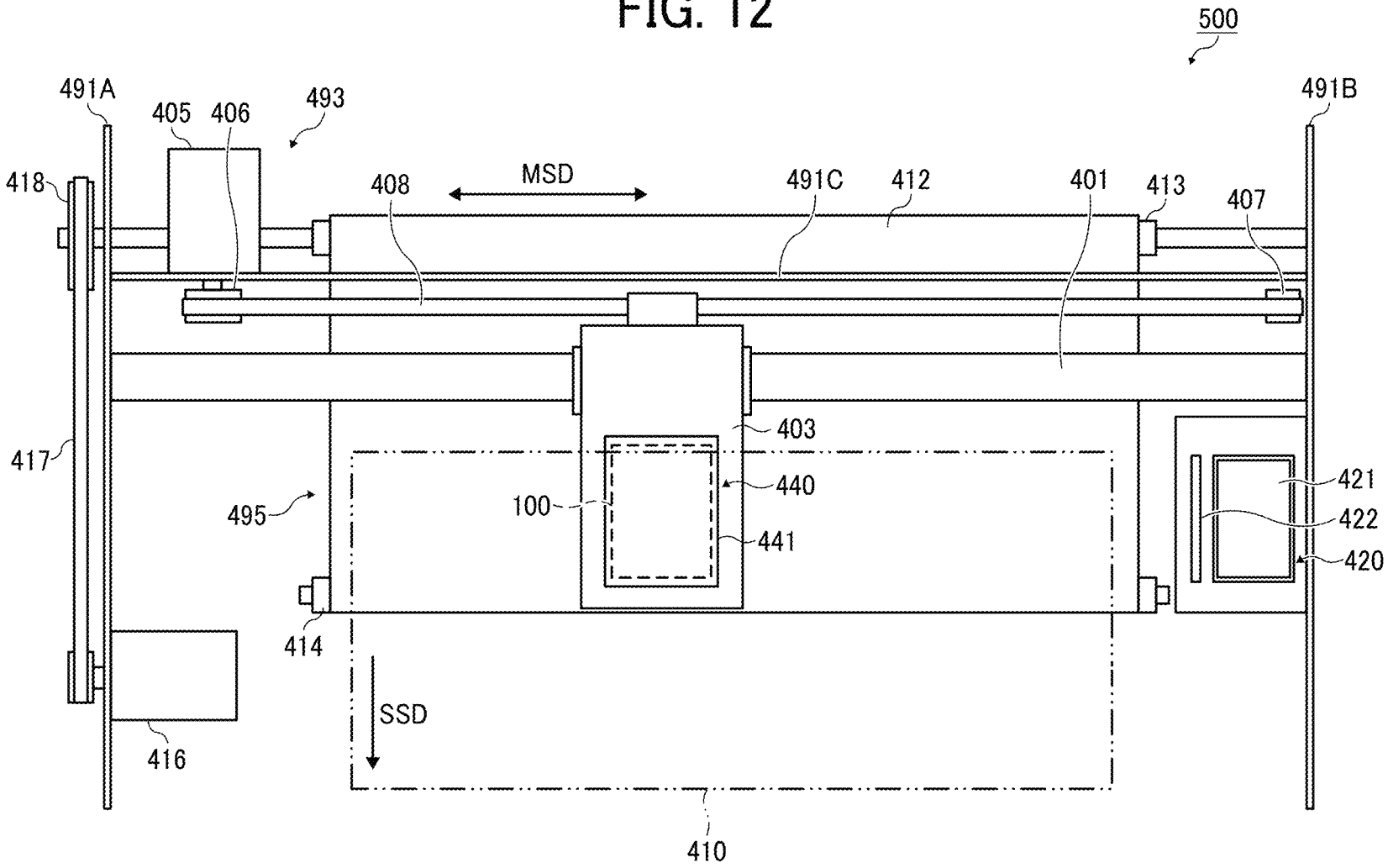
FIG. 12 is a schematic view illustrating another example of the liquid discharge apparatus according to embodiments of the present disclosure.
Figure 13:
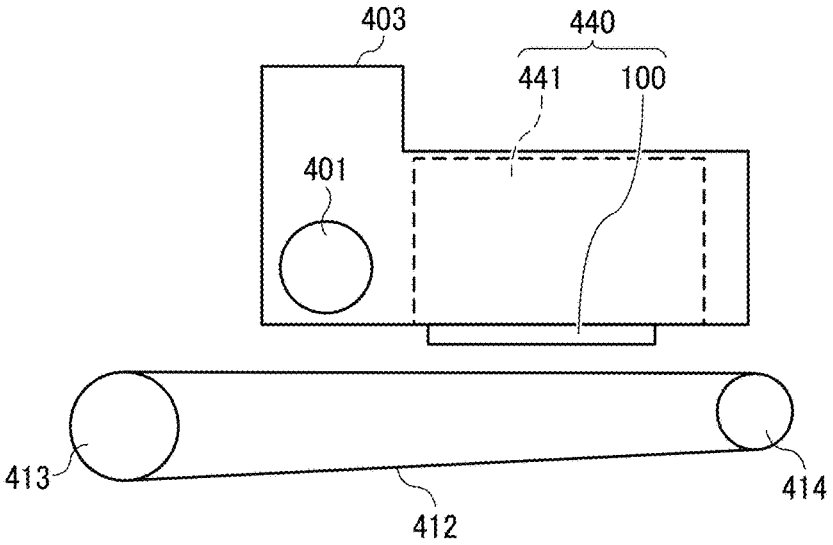
FIG. 13 is a schematic view of the liquid discharge apparatus in FIG. 12 according to embodiments of the present disclosure.

Next, another example of the printing apparatus 500 as the liquid discharge apparatus according to the embodiments of the present disclosure is described with reference to FIGS. and 13. FIG. 12 is a plan view of a part of the printing apparatus 500. FIG. 13 is a side view of the part of the printing apparatus 500 in FIG. 12.

The printing apparatus 500 is a serial type apparatus, and a main-scanning moving mechanism 493 reciprocally moves a carriage 403 in a main scanning direction indicated by arrow MSD in FIG. 12. The main-scanning moving mechanism 493 includes, e.g., a guide 401, a main-scanning motor 405, and a timing belt 408. The guide 401 is bridged between left and right side plates 491A and 491B to moveably hold the carriage 403. The main-scanning motor 405 reciprocates the carriage 403 in the main scanning direction via the timing belt 408 looped around a drive pulley 406 and a driven pulley 407.

The carriage 403 mounts a liquid discharge device 440 including the liquid discharge head 100 according to the present embodiment and a head tank 441 as a single integrated unit. The head tank 441 stores liquid to be supplied to the liquid discharge heard 100. The liquid discharge head 100 of the liquid discharge device 440 discharges color liquid of, for example, yellow (Y), cyan (C), magenta (M), or black (K). The liquid discharge head 100 includes a nozzle array including the plurality of nozzles 4 arrayed in row in the sub-scanning direction indicated by arrow SSD perpendicular to the main scanning direction indicated by arrow MSD in FIG. 12. The liquid discharge head 100 is mounted to the carriage 403 so that liquid is discharged downward from the nozzles 4. The liquid discharge head 100 is coupled to the liquid circulation device 600 described above so that liquid of a required color is circulated and supplied.

The printing apparatus 500 includes a conveyance mechanism 495 to convey a sheet 410. The conveyance mechanism 495 includes a conveyance belt 412 as a conveyor and a sub-scanning motor 416 to drive the conveyance belt 412. The conveyance belt 412 attracts the sheet 410 and conveys the sheet 410 at a position facing the liquid discharge head 100. The conveyance belt 412 is an endless belt stretched between a conveyance roller 413 and a tension roller 414. The sheet 410 can be attracted to the conveyance belt 412 by electrostatic attraction, air suction, or the like. The conveyance belt 412 circumferentially moves in the sub-scanning direction as the conveyance roller 413 is rotationally driven by the sub-scanning motor 416 via a timing belt 417 and a timing pulley 418.

On one side of the carriage 403 in the main scanning direction, a maintenance mechanism 420 that maintains and recovers the liquid discharge head 100 is disposed lateral to the conveyance belt 412. The maintenance mechanism 420 includes, for example, a cap 421 to cap a nozzle face (i.e., a face on which nozzles are formed, that is, the liquid discharge face) of the liquid discharge head 100 and a wiper 422 to wipe the nozzle face.

The main-scanning moving mechanism 493, the maintenance mechanism 420, and the conveyance mechanism 495 are mounted onto a housing including the side plates 491A and 491B and a back plate 491C. In the printing apparatus 500 having the above-described configuration, the sheet 410 is fed and attracted onto the conveyance belt 412 and conveyed in the sub-scanning direction by the circumferential movement of the conveyance belt 412. The liquid discharge head 100 is driven in response to image signals while the carriage 403 moves in the main scanning direction to discharge liquid to the sheet 410 not in motion, thus forming an image on the sheet 410.

Figure 14:
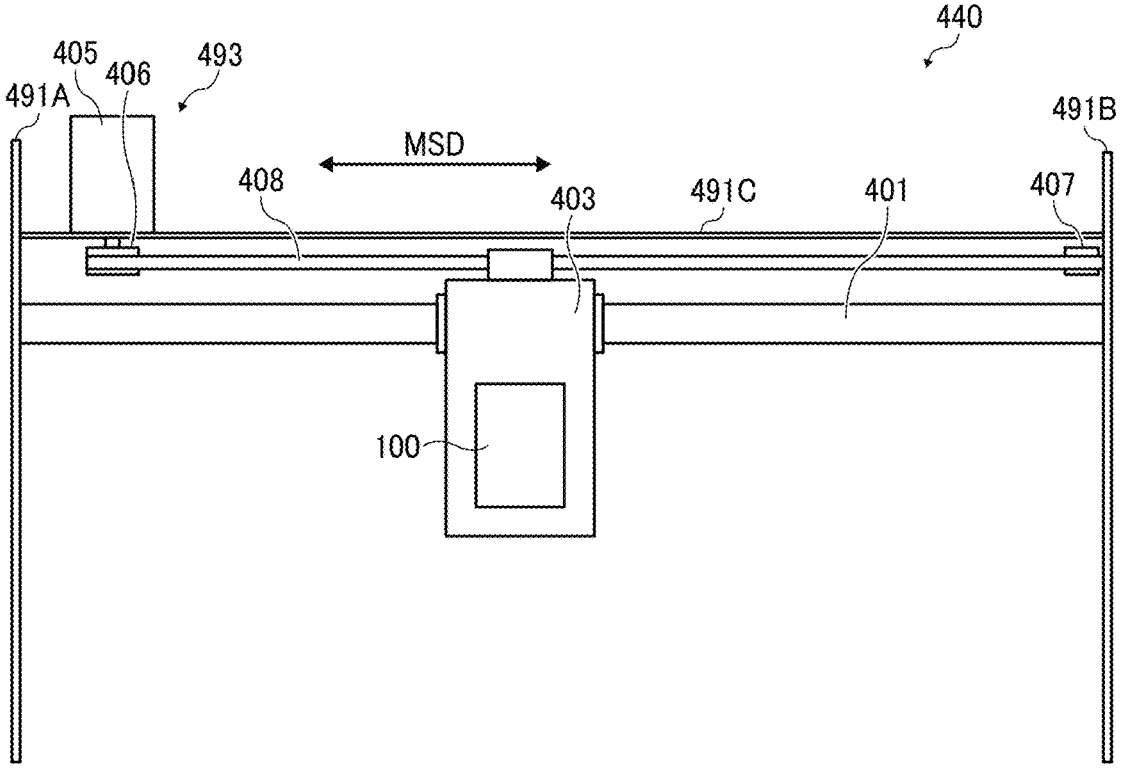
FIG. 14 is a schematic view illustrating an example of a liquid discharge device according to embodiments of the present disclosure.

Next, another example of the liquid discharge device 440 according to the embodiments of the present disclosure is described with reference to FIG. 14. FIG. 14 is a plan view of the liquid discharge device 440. The liquid discharge device 440 includes a housing, the main-scanning moving mechanism 493, the carriage 403, and the liquid discharge head 100 among components of the liquid discharge apparatus described above. The side plates 491A and 491B, and the back plate 491C constitute the housing. Note that, in the liquid discharge device 440, the maintenance mechanism 420 described above may be mounted on, for example, the side plate 491B.

Figure 15:
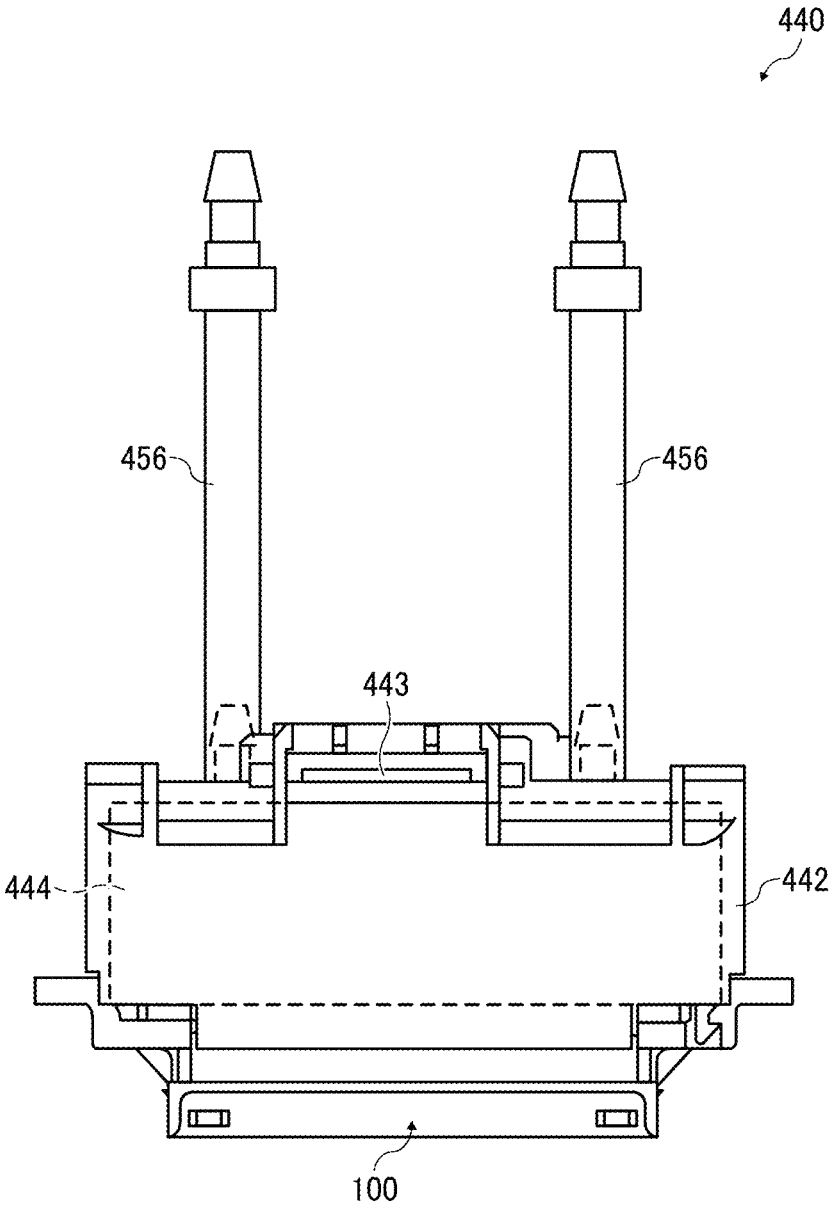
FIG. 15 is a schematic view illustrating another example of the liquid discharge device according to embodiments of the present disclosure.

Next, still another example of the liquid discharge device 440 according to the embodiments of the present disclosure is described with reference to FIG. 15. FIG. 15 is a front view of the liquid discharge device 440. The liquid discharge device 440 includes the liquid discharge head 100 to which a channel component 444 is attached, and a tube 456 connected to the channel component 444. The tube 456 serves as a supply mechanism to supply liquid to the liquid discharge head 100. The channel component 444 is disposed inside a cover 442. In some embodiments, the liquid discharge device 440 may include the head tank 441 instead of the channel component 444. A connector 443 for electrically connecting to the liquid discharge head 100 is provided on an upper portion of the channel component 444.

In the present disclosure, the liquid to be discharged is not limited to a particular liquid as long as the liquid has a viscosity or surface tension to be discharged from a head (liquid discharge head). However, preferably, the viscosity of the liquid is not greater than mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink; surface treatment liquid; a liquid for forming an electronic element component, a light-emitting element component, or an electronic circuit resist pattern; or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and a counter electrode.

The "liquid discharge device" is an assembly of parts relating to liquid discharge. The term "liquid discharge device" represents a structure including the liquid discharge head and a functional part(s) or unit(s) combined with the liquid discharge head as a single unit. For example, the "liquid discharge device" includes a combination of the liquid discharge head with at least one of a head tank, a carriage, a supply mechanism, a maintenance mechanism, a main-scanning moving mechanism, and a liquid circulation device.

Herein, the terms "integrated" and "combined" mean attaching the liquid discharge head and the functional components (or mechanisms) to each other by fastening, screwing, binding, or engaging and movably holding one of the liquid discharge head and the functional components relative to the other. The liquid discharge head, the functional components, and the mechanisms may also be detachably attached to one another.

For example, the liquid discharge head and the head tank are integrated as the liquid discharge unit. Alternatively, the liquid discharge head and the head tank coupled (connected) to each other via a tube or the like may form the liquid discharge unit as a single unit. Here, a unit including a filter may further be added to a portion between the head tank and the liquid discharge head.

In another example, the liquid discharge unit may include the liquid discharge head integrated with the carriage as a single unit.

As yet another example, the liquid discharge unit is a unit in which the liquid discharge head and the main-scanning moving mechanism are combined into a single unit. The liquid discharge head is movably held by a guide that is a part of the main-scanning moving mechanism. The liquid discharge unit may include the liquid discharge head, the carriage, and the main-scanning moving mechanism that are integrated as a single unit.

In still another example, a cap that is a part of the maintenance mechanism may be secured to the carriage mounting the liquid discharge head so that the liquid discharge head, the carriage, and the maintenance mechanism are combined into a single unit to form the liquid discharge unit.

Further, in still another example, the liquid discharge unit includes tubes connected to the liquid discharge head mounting the head tank or the channel component so that the liquid discharge head and the supply mechanism are integrated as a single unit. Through the tubes, the liquid in a liquid storage source is supplied to the liquid discharge head.

The main-scanning moving mechanism may be a guide only. The supply mechanism may be a tube(s) only or a loading device only.

The term "liquid discharge apparatus" used herein also represents an apparatus including the liquid discharge head or the liquid discharge device to drive the liquid discharge head to discharge liquid. The liquid discharge apparatus may be, for example, an apparatus capable of discharging liquid to a material onto which liquid can adhere or an apparatus to discharge liquid toward gas or into liquid.

The "liquid discharge apparatus" may include devices relating to feeding, conveyance, and ejection of the material to which the liquid can adhere and also include a pretreatment device and a post-processing device.

The "liquid discharge apparatus" may be, for example, an image forming apparatus to form an image on a sheet by discharging ink, or a three-dimensional apparatus to discharge a fabrication liquid to a powder layer in which powder material is formed in layers, so as to form a three-dimensional object.

The "liquid discharge apparatus" is not limited to an apparatus that discharges liquid to visualize meaningful images such as letters or figures. For example, the liquid discharge apparatus may be an apparatus that forms meaningless images such as meaningless patterns or an apparatus that fabricates three-dimensional images.

The above-described term "material to which liquid can adhere" denotes, for example, a material to which liquid can adhere at least temporarily, a material to which liquid can attach and firmly adhere, or a material to which liquid can adhere and into which the liquid permeates. Specific examples of the "material to which liquid can adhere" include, but are not limited to, a recording medium such as a paper sheet, recording paper, a recording sheet of paper, a film, or cloth, an electronic component such as an electronic substrate or a piezoelectric element, and a medium such as layered powder, an organ model, or a testing cell. The "material to which liquid is adhere" includes any material to which liquid can adhere, unless particularly limited.

Examples of the "material to which liquid can adhere" include any materials to which liquid can adhere even temporarily, such as paper, thread, fiber, fabric, leather, metal, plastic, glass, wood, and ceramic.

The term "liquid discharge apparatus" may be an apparatus to relatively move the liquid discharge head and the material to which liquid can adhere. However, the liquid discharge apparatus is not limited to such an apparatus. Examples of the liquid discharge apparatus include a serial type apparatus which moves the liquid discharge head, and a line type apparatus which does not move the liquid discharge head.

Examples of the liquid discharge apparatus further include: a treatment liquid applying apparatus that discharges a treatment liquid onto a paper sheet to apply the treatment liquid to the surface of the paper sheet, for reforming the surface of the paper sheet; and an injection granulation apparatus that injects a composition liquid, in which a raw material is dispersed in a solution, through a nozzle to granulate fine particle of the raw material. The terms "image formation," "recording," "printing," "image printing," and "fabricating" used in the embodiments of the present disclosure may be used synonymously with each other.

As described above, according to the present disclosure, the nozzle plate, the nozzle plate including the SOI substrate in particular, can be prevented from being warped.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A liquid discharge head, comprising:

a nozzle plate having:

a nozzle on a liquid discharge face of the nozzle plate;

a through hole communicating with the nozzle and penetrating the nozzle plate; and a substrate including:

a first silicon layer on a side of the liquid discharge face;

a second silicon layer;

a first silicon oxide film layer between the first silicon layer and the second silicon layer; and a second silicon oxide film layer on a first surface of the second silicon layer different from a second surface of the second silicon layer in contact with the first silicon oxide film layer;

a channel plate separate from the nozzle plate, the channel plate defining an individual liquid chamber communicating with the nozzle via the through hole; and an actuator configured to pressurize a liquid in the individual liquid chamber to discharge the liquid from the nozzle, wherein a first thickness of the first silicon layer is smaller than a second thickness of the second silicon layer, and a first portion of the through hole penetrating the first silicon layer has a smaller diameter than a second portion of the through hole penetrating the second silicon layer.

2. The liquid discharge head according to claim 1, wherein the first surface of the second silicon layer is opposite to the second surface of the second silicon layer.

3. The liquid discharge head according to claim 1, wherein the second silicon oxide film layer is on the first surface of the second silicon layer facing the through hole.

4. The liquid discharge head according to claim 1, wherein a total thickness of the first silicon layer and the first silicon oxide film layer is smaller than the second thickness of the second silicon layer.

5. The liquid discharge head according to claim 1, wherein a third thickness of the first silicon oxide film layer is larger than a fourth thickness of the second silicon oxide film layer.

6. A liquid discharge device, comprising:

a body; and the liquid discharge head according to claim 1.

7. The liquid discharge device according to claim 6, further comprising, integrated with the liquid discharge head as a single unit, at least one of:

a head tank configured to store a liquid to be supplied to the liquid discharge head;

a carriage configured to mount the liquid discharge head;

a supply mechanism configured to supply the liquid to the liquid discharge head;

a maintenance mechanism configured to maintain and recover the liquid discharge head; and a main-scanning moving mechanism configured to move the liquid discharge head in a main scanning direction.

* * * * *